US006209806B1

(12) United States Patent
Pace et al.

(10) Patent No.: US 6,209,806 B1
(45) Date of Patent: Apr. 3, 2001

(54) PULSED AIR ASSIST FUEL INJECTOR

(75) Inventors: Jeff B. Pace, Newport News; Vernon R. Warner, Wicomico, both of VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/228,171

(22) Filed: Jan. 11, 1999

(51) Int. Cl.[7] ..... F02M 51/00

(52) U.S. Cl. ..... 239/585.5; 239/406; 239/407; 239/416.4

(58) Field of Search ..... 239/403, 405, 239/406, 407, 415, 416.4, 533.12, 585.3, 585.1, 585.4, 585.5; 137/607; 251/129.21; 123/533, 531

(56) References Cited

U.S. PATENT DOCUMENTS 1,402,749 * 1/1922 Du Pont ..... 123/531
1,627,727 * 5/1927 Charter ..... 123/531
4,971,254 * 11/1990 Daly et al. ..... 239/533.12
5,048,497 * 9/1991 Kishida et al. ..... 123/533
5,119,792 * 6/1992 Gu ..... 123/533

* cited by examiner

*Primary Examiner*—David A. Scherbel
*Assistant Examiner*—Christopher S. Kim

(57) ABSTRACT

A fuel injector having a pulsed air assist atomizer to provide improved atomization and fuel spray targeting. The fuel injector provides a pulsed air supply, rather than a continuous air supply at the discharge of the fuel injector. The fuel injector includes an air inlet, a fuel inlet, mixing chamber and controller for controlling the simultaneous introduction of air and fuel into the mixing chamber. The controller controls an air jet to impact fuel flowing into the mixing chamber to atomize the fuel before discharge of the air-fuel mixture from the fuel injector.

6 Claims, 2 Drawing Sheets

PULSED AIR ASSIST FUEL INJECTOR

FIELD OF THE INVENTION

This invention relates to air assist fuel injectors used in internal combustion engines and in particular to a fuel injector with a pulsed air assist atomizer.

BACKGROUND OF THE INVENTION

It is known in the art relating to fuel injectors to atomize the fuel injected through the nozzle of a fuel injector. In such fuel injection systems, fuel is atomized into a finely divided spray of small droplets by mixing air with the fuel upon discharge of the mixture from the fuel injector. Air assist atomization of the fuel injected from the fuel injector is used to produce a homogeneous air-fuel mixture. The homogeneity of the air-fuel mixture and gasification of fuel droplets in the combustion space affect the efficiency of the combustion process. A better mixture of air and fuel will produce both a cleaner and a more efficient combustion process. Therefore, it is desirable to obtain a fuel injector that has optimum atomization and accurate fuel spray targeting.

SUMMARY OF THE INVENTION

The present invention provides a fuel injector which supplies pulsed air, rather than a continuous supply of air through the fuel injector. By supplying pulsed air, the atomization and fuel spray targeting are improved. The fuel injector includes air inlet means, fuel inlet means, a mixing chamber and control means for simultaneously controlling introduction of air and fuel into the mixing chamber.

In one embodiment, the fuel injector includes two electromagnetically actuated valves that are used to control an air jet that impacts fuel flowing into a mixing chamber. The controlled air and fuel flows provide atomization of the fuel before discharge of the air-fuel mixture from the injector. The two valves are part of an armature/valve assembly. The assembly includes an armature, air control valve head and hollow needle which forms part of a fuel control valve. The armature is connected to the hollow needle. The air control valve head is mounted on a first axial inlet end of the hollow needle.

In a closed position, the valve head and a second axial outlet end of the needle are seated against an air valve seat and fuel valve seat, respectively, to prevent air and fuel flow into the mixing chamber. Upon energization of an electromagnetic coil, the armature is attracted to a stator and the valve head and needle are lifted from their seats to allow air and fuel flow into the mixing chamber. As the fuel enters the mixing chamber, it is impacted by the air jet resulting in a finely atomized spray. Then the air-fuel mixture is discharged from the fuel injector through a central opening in the fuel valve seat.

These and other features and advantages of the invention will be more fully understood from the following detailed description of the invention taken together with the accompanying drawings.

BRIEF DESCRIPTION OF THE DRAWINGS

The accompanying drawings, which are incorporated herein and constitute part of this specification, illustrate presently preferred embodiments of the invention, and, together with a general description given above and the detailed description of the preferred embodiments given below, serve to explain the principles of the invention.

DETAILED DESCRIPTION OF THE INVENTION

Figure 1:
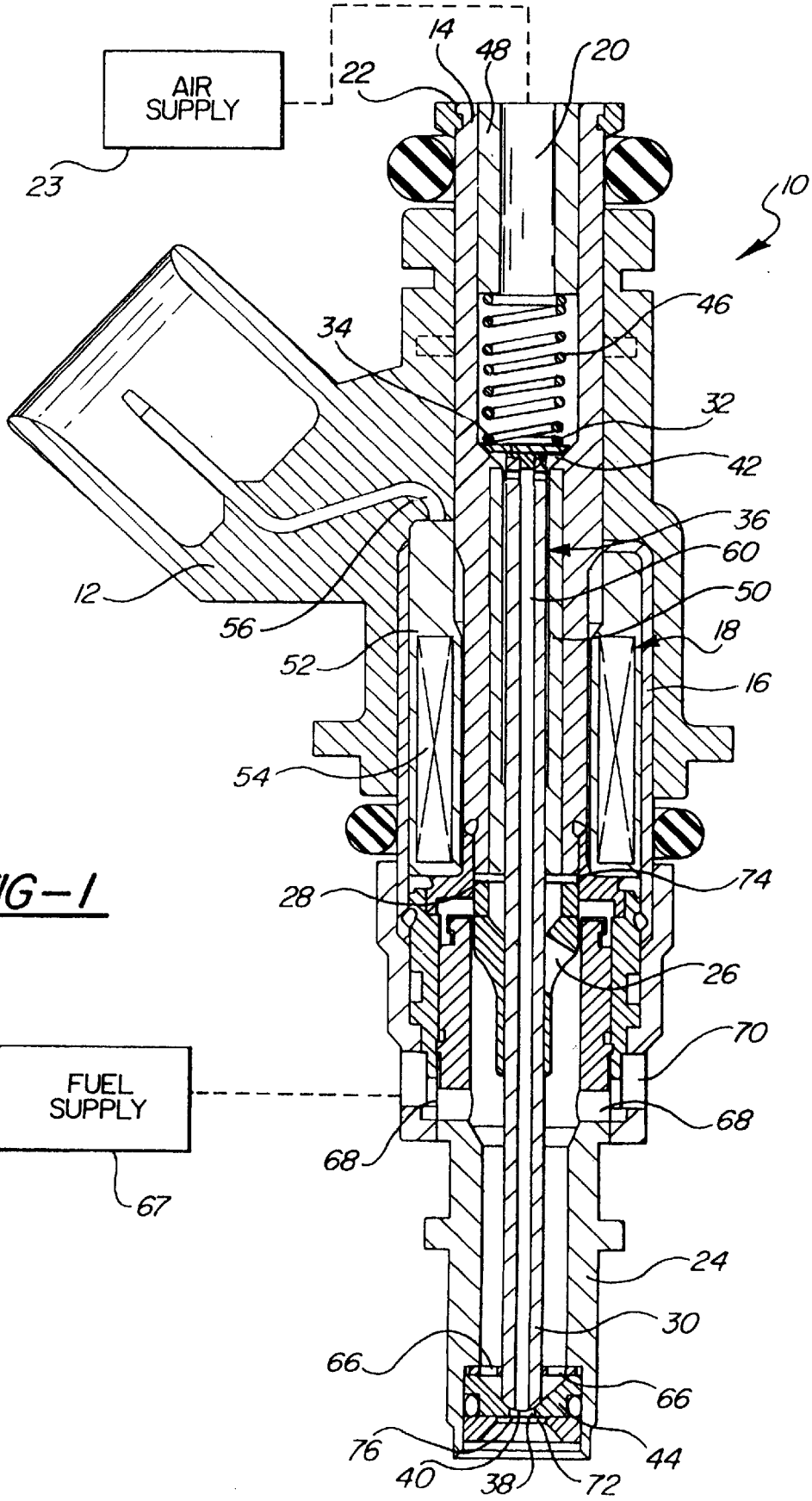
FIG. 1 is a cross-sectional view of a fuel injector in accordance with the present invention.

Referring now to the drawings in detail, numeral 10 generally indicates a fuel injector including a pulsed air assist atomizer. The fuel injector 10 provides a pulsed air jet that impacts the fuel when fuel is being discharged from the injector 10, and not as a continuous air supply as in conventional air assist injectors, thereby improving the atomization of the fuel.

Figure 2:
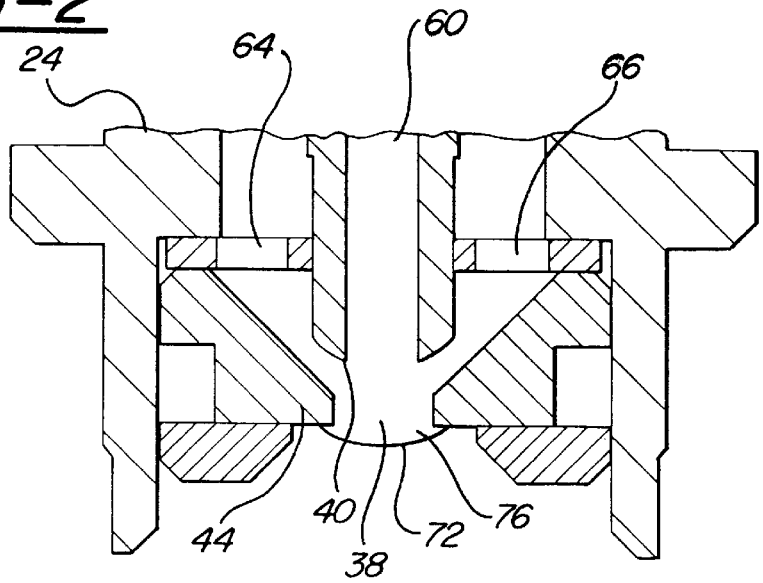
FIG. 2 is an enlarged schematic view of the lower end of the fuel injector, illustrating a hollow needle in an open position allowing fuel and air to mix in a mixing chamber during discharge of the fuel injector.

With reference to FIGS. 1 and 2, the injector 10 includes a plastic cover 12. The plastic cover 12 surrounds upper portions of a tubular stator 14 and a coil assembly housing 16. Coil assembly 18 surrounds a lower portion of stator 14. Stator 14 is ferromagnetic and has an air inlet 20 at a first axial end 22 of the stator 14 connected to a pressurized air supply 23. Below the coil assembly 18 is a valve body 24 in which an armature 26 is reciprocally disposed and positioned coaxially with a second axial end 28 of the stator 14.

The armature 26 is connected with a hollow needle 30 which has an air control valve head 32 mounted on a first axial inlet end 34 of the needle 30 to form an armature/valve assembly 36. The valve head 32 may be in the form of a poppet valve. The armature/valve assembly 36 is movable between open and closed positions to permit or prevent air and fuel flow into a mixing chamber 38 at the discharge end of the fuel injector. The valve head 32 and a second axial outlet end 40 of the needle 30 are normally urged against an air valve seat 42 and a fuel valve seat 44, respectively, in their closed positions by a spring 46 which engages the valve head 32. The spring 46 is compressed to desired force by an adjustment tube 48 which is pressed to an axial position within the stator 14 and defines the air inlet 20. The air valve seat 42 forms one end of a valve tube 50 which is pressed to a mounted axial position within the stator 14. The valve tube 50 extends from the spring 46 to the second axial end 28 of the stator 14.

The needle 30 and valve head 32 are simultaneously unseated from their seats 44, 42 to their open positions to allow fuel and air flow in the mixing chamber 38 when the armature 26 is magnetically attracted to the stator 14 upon energization of the coil assembly 18. The coil assembly 18 includes a plastic bobbin 52 on which an electromagnetic coil 54 is wound. Electrical terminals 56 are connected between an electrical circuit (not shown) and the coil 54 for providing energizing voltage to the coil that operates the fuel injector 10.

Figure 3:
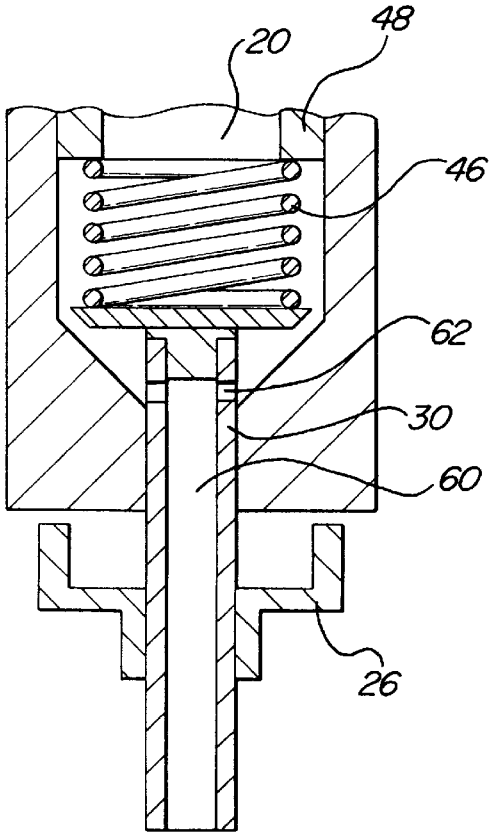
FIG. 3 is an enlarged schematic view of the upper end of the fuel injector, illustrating an air control valve head in an open position.

The hollow needle 30 has a central air passage 60 extending from the first axial inlet end 34 of the needle 30 to the second axial outlet end 40 of the needle 30. The air passage 60 conveys air from the air inlet 20 to the mixing chamber 38. Air enters the air passage 60 through air holes 62 in the first axial end 34 of the needle 30 as shown in FIG. 3. The diameter of the hollow needle 30 may be larger than a conventional valve needle to accommodate the air passage 60. If a needle 30 with a larger diameter is used, a lower valve lift is required to pass the fuel thereby supplying a thinner fuel film which enhances atomization from the air jet.

The armature 26 is guided by an inside wall of the valve body 24 for axial reciprocation. The upper portion of the hollow needle 30 is guided within the valve tube 50. Further, axial guidance for the needle 30 is provided by a fluid metering member 66 through which the hollow needle 30 extends. The fluid metering meter 66 is disposed within the valve body 24 upstream from the fuel valve seat 44.

Fuel from a fuel supply 67 enters the fuel injector 10 through fuel inlets 68 in the valve body 24. A filter assembly 70 is fitted to the fuel inlets 68 to filter particulate matter from the fuel entering the valve body 24 through the inlets 68. Filtered fuel flows through the fluid metering member 66 which provides a thin fuel film to be impacted by the air jet from the second axial end 40 of the hollow needle 30 in the mixing chamber 38. The fluid metering member 66 may be a swirl generator plate or an orifice plate. The member 66 is located upstream from the mixing chamber 38. Also, the air-fuel mixture may be metered by a second metering member 72, such as a thin orifice disk, located downstream from the fuel valve seat 44 at the discharge end of the fuel injector 10.

In operation, fuel enters the fuel inlets 68 and passes through the filter assembly 70 into the valve body 24 and through opening 64 in the fluid metering member 66 to the fuel valve seat member 44. When the coil 54 is not energized, the hollow needle 30 and air control valve head 32 are biased by the spring 46 into their respective closed positions and a small working gap 74 exists between the armature 26 the stator 14.

Upon energizing of the coil 54, the armature 26 is magnetically attracted to the second axial end 28 of the stator 14, closing the working gap 74. This movement simultaneously unseats the hollow needle 30 from the fuel valve seat 44 and lifts the air control valve head 50 from the air valve seat 42, allowing fuel film to be impacted by an air jet in the mixing chamber 38, resulting in a finely atomized spray. The atomized spray is discharged from the fuel injector through a central opening 76 in the fuel valve seat 44. Upon deenergizing of the coil 54, the spring 46 pushes the hollow needle 30 and air control valve head 32 back to their closed positions, shutting off fuel and air flow.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A fuel injector for an internal combustion engine, comprising:

an air supply inlet;

a fuel supply inlet;

a mixing chamber located at a discharge end of the fuel injector for mixing air and fuel;

a control member for controlling the simultaneous introduction of air and fuel into said mixing chamber, the control member including:

an armature/valve assembly movable between valve open and closed positions to admit or prevent air and fuel flow into the mixing chamber, the armature/valve assembly including:

a fuel control valve having a hollow needle defining a central air passage for conveying air from a first axial end of said needle to a second axial end of said needle, said hollow needle being movable between valve open and closed positions to unseat or seat the second axial end of the needle from or against a valve seat to admit or prevent fuel flow into the mixing chamber;

an air control valve head mounted on the first axial end of the hollow needle and said valve head being movable with the needle between open and closed positions to unseat or seat the valve head from or against an air valve seat to admit or prevent air flow into the central air passage; and an armature connected with said hollow needle and movable toward and away from a tubular stator to simultaneously open or close the fuel and air control valves and admit or prevent fuel and air flow into the mixing chamber;

a coil assembly surrounding the tubular stator for generating electromagnetic forces to magnetically attract the armature/valve assembly to the stator to allow air and fuel to flow into the mixing chamber; and biasing means for biasing the armature/valve assembly away from the stator toward the valve closed position to prevent air and fuel from flowing into the mixing chamber.

2. A fuel injector as in claim 1 wherein the air control valve is a poppet valve and the first axial end of the hollow needle has air holes for allowing air to flow into the central air passage.

3. A fuel injector as in claim 1 wherein the biasing means is a spring acting between a head of the air control valve and an adjustment tube fixed in said air inlet means.

4. A fuel injection system comprising:

an air supply providing a flow of assist air;

a fuel supply providing a supply of fuel;

a fuel injector having a mixing chamber receiving assist air and fuel; and a control member controlling the simultaneous introduction of air and fuel into said mixing chamber, the control member including:

an armature/valve assembly movable between valve open and closed positions to admit or prevent air and fuel flow into the mixing chamber, the armature/valve assembly including:

a fuel control valve having a hollow needle defining a central air passage for conveying air from a first axial end of said needle to a second axial end of said needle, said hollow needle being movable between valve open and closed positions to unseat or seat the second axial end of the needle from or against a fuel valve seat to admit or prevent fuel flow into the mixing chamber;

an air control valve head mounted on the first axial end of the hollow needle and said valve head being movable with the needle between open and closed positions to unseat or seat the valve head from or against an air valve seat to admit or prevent air flow into the central air passage; and an armature connected with said hollow needle and movable toward and away from a tubular stator to simultaneously open of close the fuel and air control valves and admit or prevent fuel and air flow into the mixing chamber;

a coil assembly surrounding the tubular stator for generating electromagnetic forces to magnetically attract the armature/valve assembly to the stator to allow air and fuel to flow into the mixing chamber; and biasing means for biasing the armature/valve assembly away from the stator toward the valve closed position to prevent air and fuel from flowing into the mixing chamber.

5. A fuel injection system as in claim 4 wherein the air control valve is a poppet valve and the first axial end of the hollow needle has air holes for allowing air to flow into the central air passage.

6. A fuel injection system comprising:

an air supply providing a flow of assist air;

a fuel supply providing a supply of fuel;

a fuel injector having a mixing chamber receiving assist air and fuel; and a control member controlling the simultaneous introduction of air and fuel into said mixing chamber, the control member including:

an armature/valve assembly movable between valve open and closed positions to admit or prevent air and fuel flow into the mixing chamber;

a coil assembly surrounding a tubular stator for generating electromagnetic forces to magnetically attract the armature/valve assembly to the stator to allow air and fuel to flow into the mixing chamber; and biasing means for biasing the armature/valve assembly away from the stator toward the valve closed position to prevent air and fuel from flowing into the mixing chamber, wherein the biasing means is a spring acting between a head of the air control valve and an adjustment tube fixed in said air inlet means.

* * * * *